United States Patent [19]

Humen

[11] 3,973,469

[45] Aug. 10, 1976

[54] FLOATING CHAMBER MACHINE

[76] Inventor: John Humen, P.O. Box 877, Elkton, Md. 21921

[22] Filed: Dec. 16, 1974

[21] Appl. No.: 533,334

[52] U.S. Cl. ..... 91/51; 91/196; 92/119; 92/122; 92/161

[51] Int. Cl.[2] ..... F01B 15/00; F01C 9/00; F15B 13/04

[58] Field of Search ..... 91/3, 196, 51; 92/122, 92/119, 161

[56] References Cited

UNITED STATES PATENTS

| | | | |
|---|---|---|---|
| 2,670,717 | 3/1954 | Armington | 92/119 |
| 2,723,574 | 11/1955 | Mueller | 92/119 |
| 3,110,228 | 11/1963 | Shramo et al. | 92/122 |

*Primary Examiner*—Paul E. Maslousky
*Attorney, Agent, or Firm*—Dayton R. Stemple, Jr.

[57] ABSTRACT

An orbiting, floating mechanism which reciprocates while rotating and is capable of varying, stopping, or reversing a flow of fluid therethrough at any one revolution or any combination of revolutions or any part thereof.

17 Claims, 11 Drawing Figures

FLOATING CHAMBER MACHINE

BACKGROUND OF THE INVENTION

This invention relates to volume displacement devices which may be used to produce power and/or transmit power.

Variable volume, rotary reciprocal, rotary or reciprocal volume displacement devices have been used in power applications such as engines, torque converters, hydraulic motors, pumps and compressors. Such fluid handling devices tend to be for specific applications only and do not offer flexibility of utilization. In addition, prior systems have been of complex structure which in the most part is expensive to maintain, operate and manufacture.

SUMMARY OF THE INVENTION

The invention disclosed herein overcomes the problems inherent in the prior art devices as suggested above and accomplishes these goals through the cooperation of three basic moving parts. The basic parts of the device are, a floating chamber, a displacer hollow yoke shaft, and a supplement hollow yoke shaft. These basic moving parts are adapted such that when used in combination with a chamber divider they form a mechanism capable of creating multiple movements when rotated. The movements are rotary, reciprocal and orbital. During operation of the apparatus, the volume within the floating chamber is displaced by the displacer portion of the displacer hollow yoke shaft and as a result pressure increases within the chamber on one side of the displacer and decreases on the other side of the displacer. A system of ports and valves is positioned in the three basic parts of the device in a predetermined pattern to enable the creation of partial vacuum within one hollow yoke shaft which results in drawing in a volume that is expelled through the other hollow yoke shaft after pressurization by the chamber moving towards the displacer. A variable volume effect may be accomplished by differential movement of the hollow yoke shafts. When the shafts are moved towards each other volume flow increases and when they are moved away from each other the displaced volume is decreased. When both hollow yoke shafts are positioned about a common center line the mechanism functions at a zero fluid flow level. The fluid flow can be reversed while the apparatus is in operation by moving the hollow yoke shafts to the opposite side of the common center line.

OBJECTS AND ADVANTAGES OF THE INVENTION

A primary objective of the instant invention is to provide a basic mechanism which is capable of providing instantaneous changes in fluid flow.

A further objective of the invention is to provide an unique chamber incorporating multiple pressure maintaining compartments that can displace more than one fluid substance at one time.

A further objective of the instant invention is to provide a simple and inexpensive apparatus which overcomes the disadvantages and limitations of the prior art.

A further objective of the invention is to provide an integral rotary-radiator and pump mechanism with an integral power source.

A further objective of the invention is to provide a light weight and compact displacement device of increased efficiency and versatility.

A still further object of the invention is to provide basic apparatus for a power transmission and/or hydraulic motor.

Another advantage of the invention is to make available the basic structure for a fluid flow mechanism capable of functioning as a two cycle or four cycle engine.

A further objective of the instant invention is to provide a basic mechanism which is capable of functioning as a steam engine and/or other gas expansion power devices including devices utilizing a Sterling cycle.

A further advantage of the invention is to provide an apparatus capable of multistage compression at a variable or fixed ratio.

Another objective of the invention is to provide the basic mechanism for an electric or electronic generator driven by an integral electric motor in combination with or otherwise driven thereby.

A still further objective of the invention disclosed herein is to provide a mechanism which will provide hybrid power applications.

A still further advantage of the invention is to provide a chamber incorporating multipressure compartments of similar and/or opposed volumes capable of having superior sealing between pressurized compartments.

Another objective of the invention is to provide an optical effects mechanism when constructed of a transparent or reflective material.

Further objects, features, and novelties of the invention will become apparent from the following description of an embodiment thereof which is given by way of example and is described with reference to the accompanying drawings in which:

PREFERRED EMBODIMENT

Figure 1:
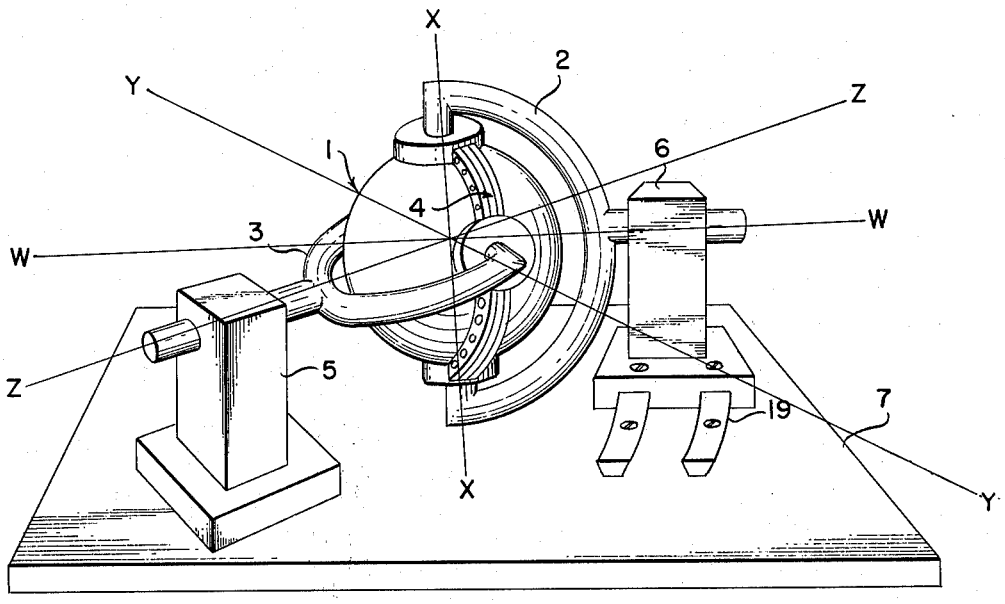
FIG. 1 is a perspective view of an embodiment of the invention.

Referring to the drawings in greater detail wherein like parts are represented by like reference characters, the floating chamber machine is shown generally in FIG. 1. The floating chamber 1 is supported by displacer hollow yoke chamber support shaft 2 and supplement hollow yoke chamber support shaft 3. Low friction shaft support structures 5 and 6 support shafts 3 and 2 respectively for rotational movement about and lineal movement along the axes of the shafts. Support structure 5 is securely fastened to base plate 7 and support structure 6 is attached to base plate 7 by a pair of rails 19 adapted to allow movement of the displacer hollow yoke chamber support shaft 2 and its support structure 6.

Bearings are provided in support structures 5 and 6 to support the support shafts 3 and 2 and bearings incorporating gas seals are provided between the shafts and the floating chamber 1 at the four locations identified as 8. The floating chamber 1 is comprised of two hemispheres identified as item 20 of FIG. 4 and two chamber dividers identified as item 4 of FIG. 5. The hemispheres and dividers are assembled to form a sphere with an internal dividing means by a plurality of fasteners adapted to cooperate with holes 18 provided in the hemispheres and divider means.

Figure 2:
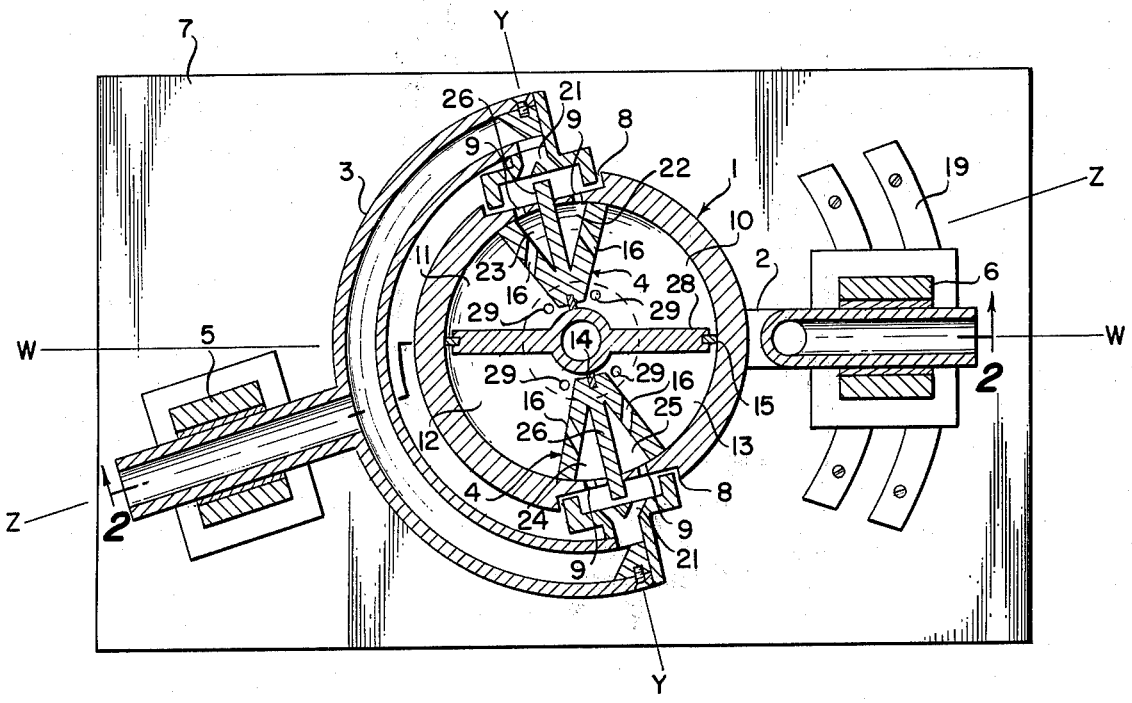
FIG. 2 is a horizontally cut away sectional view of the device illustrated in FIG. 1 and taken along line I—I of FIG. 3.

FIG. 2 illustrates the route through which gas flows through supplement hollow yoke chamber support shaft 3. Assuming gas flow is into the chamber through support shaft 3, the flow is through the supporting end of the shaft into the two arms of the yoke and then through ports 21. From ports 21, the gas flows through ports 9 into chambers 22, 23, 24 and 25 as a function of the angular position between the floating chamber 1 and support shaft 3. Gas flow from the fixed dimension chambers 22, 23, 24 and 25 proceeds through ports 16 into variable volume chamber 10, 11, 12 and 13. The valve switching arrangement accomplished between the various ports 21 and 9 in FIG. 2 is accomplished by the movement of the floating chamber in communication with yoke arms.

The variable volume chambers 10, 11, 12 and 13 are isolated from each other by seals 14 and 15.

Figure 3:
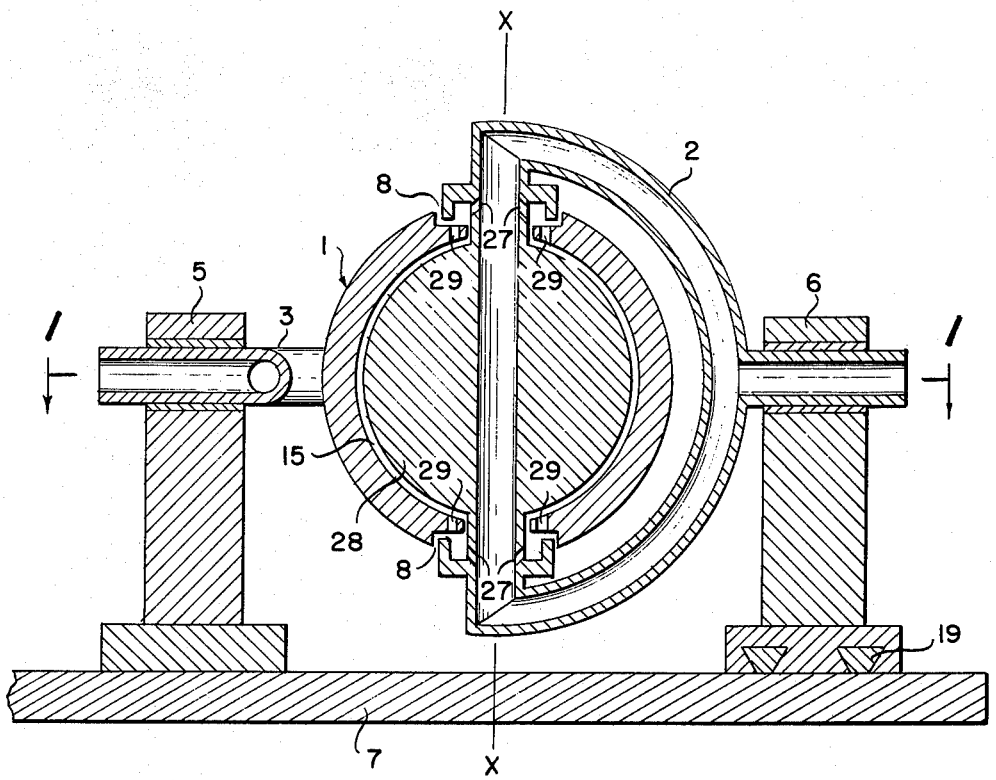
FIG. 3 is a vertical sectional view taken along line 2—2 of FIG. 2.

FIG. 3 illustrates the gas flow path for displacer hollow yoke chamber support shaft 2. Assuming gas is flowing into the floating chamber 1, the path is through ports 29 into ports 27 and through the yoke arms to the support shaft. Two ports 27 are provided at each end of the yoke arms and they are adapted to cooperate with four ports 29 positioned at either end of the floating chamber. FIG. 2 illustrates one set of ports 29 and graphically displays the positioning between ports 29 and the chamber dividers 4. Note that as the angular position between the floating chamber 1 and displacer 28 of the support shaft 2 varies, different opposing pairs of ports 29 are opened or closed.

An instantaneous variable volume fluid flow during operation of this invention is accomplished by the movement of shaft support structure 6 toward a common center line of both shafts 2 and 3. Fluid flow decreases as the shafts approach the center lines until the center lines are in common and then fluid flow stops. If the support structure is moved beyond the center line, fluid flow commences in increasing magnitude in an opposite direction. Hence fluid flow is reversed through the floating chamber by moving shaft 2 through the common center line of shafts 2 and 3. The rate of flow is a function of the displacement of the shaft support structure 6 from the common center line.

Figure 4:
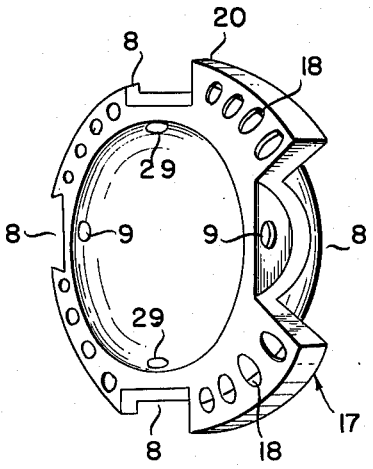
FIG. 4 is a perspective view of the right half side of the chamber illustrated in FIG. 1.
Figure 5:
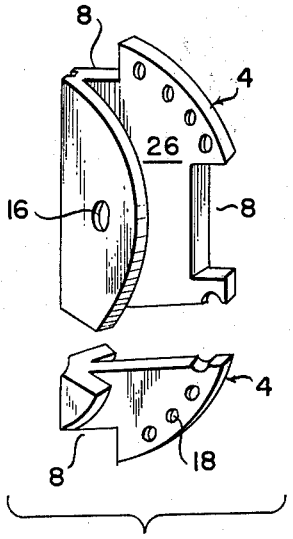
FIG. 5 is a horizontal sectional perspective view of a chamber divider utilized in the instant invention.

To insure proper volume flow, the chamber dividers 4 are fitted with seals 14 and the displacer of shaft 2 is fitted with seals 15. The half chamber 17 of FIG. 4 is identical to the other half of the chamber in that, when fastened together with opposed dividers 4 therebetween, the corresponding holes 18 and floating chamber bearing location openings 8 are in alignment.

ALTERNATE EMBODIMENT

Figure 6:
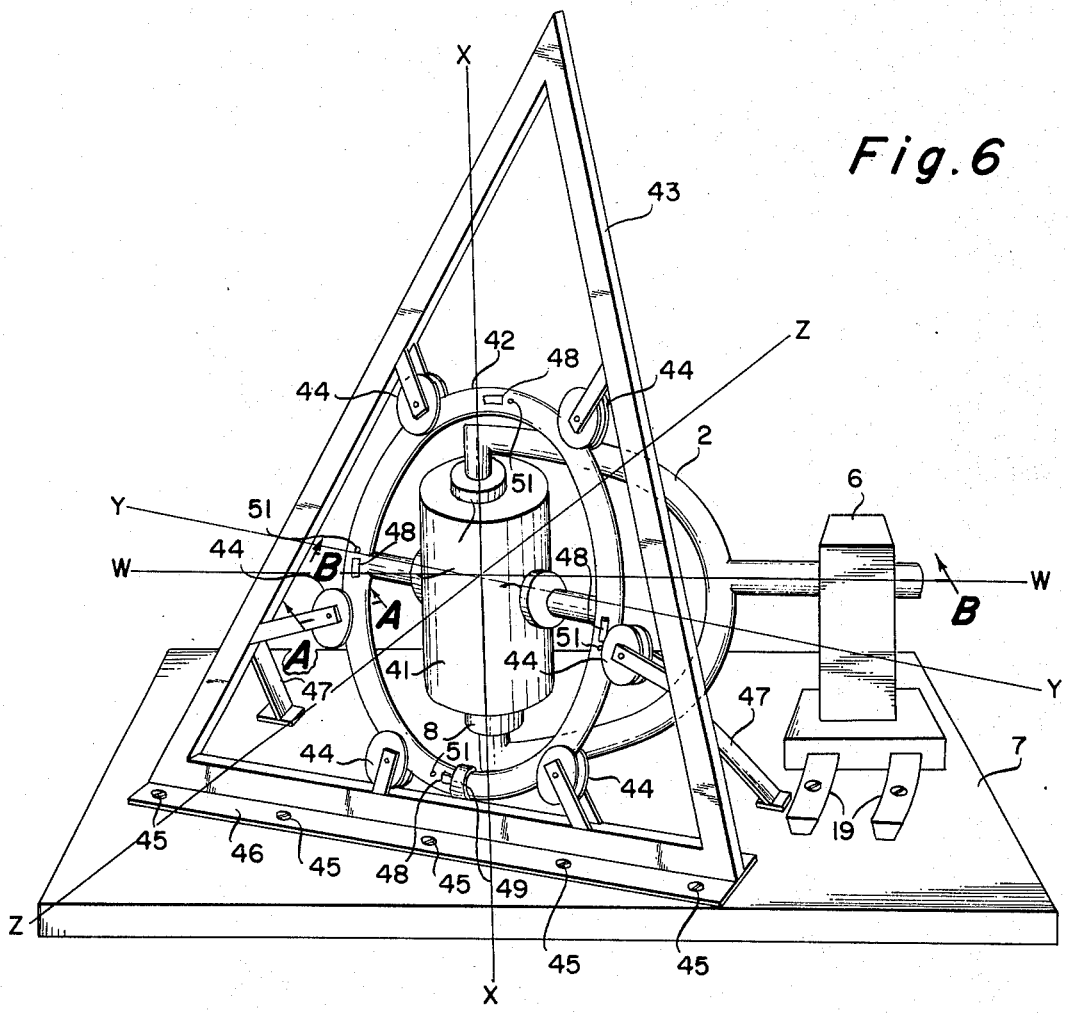
FIG. 6 is a perspective view of an alternate embodiment of the invention.

FIG. 6 discloses an alternate embodiment wherein the spherical floating chamber 1 is replaced by a cylindrical floating chamber 41. The chamber is supported by a displacer hollow yoke chamber support 2 which is basically identical with the displacer hollow yoke chamber support 2 of FIG. 1. Note also in FIG. 6 that the embodiment utilizes a low friction shaft support structure 6 that is fastened to the base via a pair of rails 19 as in the embodiment illustrated by FIG. 1.

The internal structure of the floating cylindrical chamber 41 may be visualized by referring to FIG. 2 which provides a cutaway view of the spherical chamber 1 of FIG. 1 as well as a cutaway view taken along plane B-B of FIG. 6.

Four bearings incorporating gas seals are provided between shafts and the floating chamber 41 at the four locations identified as 8 in FIG. 6. These subassemblies are identical to similar structure identified in FIGS. 2 and 3.

In FIG. 6, a halo yoke 42 completely encircles the cylindrical chamber 41 and provides support thereto via a pair of bearings incorporating gas seals and gas ports as illustrated at area 8 of FIG. 2.

Figure 7:
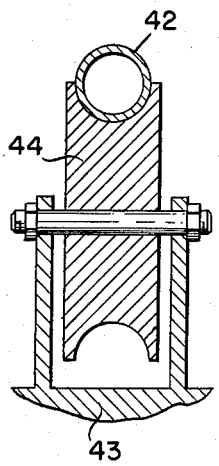
FIG. 7 is a cut away sectional view of the device illustrated in FIG. 6 taken along line A—A.

The halo yoke 42 is supported by a triangular structure 43 via a plurality of idler pulleys 44. The interaction between the yoke 42, support 43, and idlers 44 may best be seen in the cutaway view depicted in FIG. 7.

The halo support structure 43 may be fastened to base 7 by a plurality of fasteners 45 and flange 46. Braces 47 may be included to add rigidity to the structure.

Figure 10:
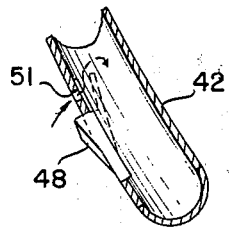
FIG. 10 is an enlarged sectional view of the halo yoke of FIG. 6 illustrating the hinged wedge valve.

The halo yoke 42 incorporates a plurality of hinged wedge valves 48 that are spring loaded in a closed position. FIG. 10 is an enlarged sectional view of the halo yoke 42 illustrating a single hinged valve 48 in a partially open position allowing fluid to pass therethrough.

Figure 8:
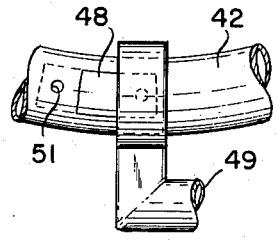
FIG. 8 is an enlarged view of the gas communicating port of the embodiment illustrated in FIG. 6.
Figure 9:
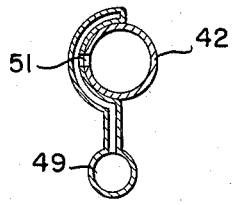
FIG. 9 is a cut away view of the gas communicating port area illustrating the fluid passage between the yoke and yoke support.

FIGS. 8 and 9 illustrate a combination fluid communicating passage and wedge valve actuator 49 which functions to depress a hinged wedged valve 48 which opens an orifice 51 in the halo yoke 42 to allow fluid to flow between fluid passage 49 and the interior of the halo yoke. The orientation of the wedge portion of the hinged wedge valve and port 51 may best be seen in FIG. 8, and FIG. 9 illustrates the relationship between the port 51 and the fluid passage 49.

It will be appreciated that there are four imaginary axes for describing movement in this invention which intersect at the centers of spherical chamber 1 or cylindrical chamber 41 which will be recited numerically for clarity in the claims. The axes are superimposed on appropriate Figures. The first axis, x—x, (FIGS. 1, 3 and 6) passes vertically through the center of the chambers 1 and 41 and intersecting the radial center of top and bottom seals 8. The second axis, w—w, (FIGS. 1, 2 and 6) passes along the center of seals 15 intersecting in parallel the unnumbered support arm of yoke 2. The third axis, y—y, (FIGS. 1, 2 and 6) passes along the center of seals 14 and intersecting the radial center of side seals 8. The fourth axis, z—z, intersects in parallel the unnumbered support arm of yoke 3 in FIGS. 1 and 2 and is horizontally in parallel with the radial center of halo yoke 42 in FIG. 6.

Figure 11:
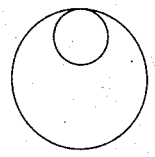
FIG. 11 is a typical trajectory described by the operation of the apparatus.

The hollow chamber of the apparatus describes a trajectory as illustrated in FIG. 11 when orbiting in an unrestrained mode. The surfaces of the invention may be of a light reflective material and thus be used to create optical effects when properly illuminated.

The invention and its attendant advantages will be understood from the foregoing description and it will be apparent that various changes may be made in the form, construction, and/or arrangement of the parts of the invention without departing from the spirit and scope thereof or sacrificing its material advantages, the arrangement herebefore described being merely by way of example and not to be implied to restrict the invention to the specific form or uses mentioned except as defined in the accompanying claims.

I claim:

1. A floating chamber machine, comprising:

a hollow chamber;

a first support yoke including a fluid passage therethrough and adapted to support said hollow chamber and allow rotational movement thereof about a first axis;

a first yoke support adapted to support said first support yoke and allow rotational movement thereof about and lineal movement along a second axis perpendicular to said first axis;

a second support yoke including a fluid passage therethrough and adapted to support said hollow chamber and allow rotational movement thereof about a third axis bisecting the common intersection of said first and second axes;

a second yoke support adapted to support said second yoke and allow rotational movement thereof about a fourth axis perpendicular to said third axis;

a first divider rigidly affixed to said first support yoke and adapted to fit within said hollow chamber and bisect said hollow chamber along said first axis;

a split divider comprised of two halves, each rigidly affixed to the interior of said hollow chamber on opposite sides of said first divider and adapted to bisect said hollow chamber along said third axis;

first fluid port means adapted to permit fluid flow between said hollow chamber and said first support yoke as a function of angular position therebetween about said first axis; and second gas port means adapted to permit gas flow between said hollow chamber and said second support yoke as a function of the angular position therebetween about said third axis.

2. An apparatus as defined in claim 1, further including means to enable movement of said first yoke support radially to said common intersection of said first, second, third, and fourth axes and transverse to said second axis.

3. An apparatus as defined in claim 1 wherein said first fluid port means comprises:

a plurality of fluid ports positioned in said hollow chamber about said first support yoke; and a plurality of fluid ports in said first support yoke positioned to cooperate with said fluid ports in said hollow chamber.

4. An apparatus as defined in claim 1 wherein said second fluid port means comprises:

a plurality of fluid ports positioned in said hollow chamber about said second support yoke;

a plurality of fluid ports in said second support yoke positioned and adapted to cooperate with said hollow chamber fluid ports; and a plurality of fluid ports positioned and adapted in said split divider for cooperation with said hollow chamber fluid ports and said second support yoke fluid ports.

5. An apparatus as defined in claim 4 wherein said first divider and said split divider are adapted to cooperate with said first and second fluid port means to provide interrelated variable volume chambers associated with fluid flow paths between said first and second support yokes.

6. An apparatus as defined in claim 5 wherein said first divider includes seal means affixed along its outer periphery for cooperation with the inner surfaces of said hollow chamber.

7. An apparatus as defined in claim 6 wherein said split divider includes seal means on each half adapted to cooperate with the portion of said first yoke support passing through said hollow chamber.

8. An apparatus as defined in claim 7 wherein said hollow chamber, said first and second support yokes and said first and second yoke supports are adapted to permit reciprocal, rotary, and orbital motion of said hollow chamber.

9. An apparatus as defined in claim 8 wherein said hollow chamber is comprised of a plurality of compartments.

10. An apparatus as defined in claim 9 wherein said first divider comprises a plurality of displacers adapted to create volume flow through said compartments.

11. An apparatus as defined in claim 10 wherein said displacers are adapted to permit instantaneous changes in said volume flow.

12. An apparatus as defined in claim 1 configured to function as an optical effects apparatus.

13. An apparatus as defined in claim 1 wherein said hollow chamber is a sphere.

14. An apparatus as defined in claim 1 wherein said hollow chamber is a cylinder.

15. An apparatus as defined in claim 7 wherein said hollow chamber, said first and second support yokes and said first and second yoke supports are adapted to permit said hollow chamber to describe a limacon trajectory.

16. An apparatus as defined in claim 1, wherein said second support is additionally adapted to allow lineal movement of said second yoke along said fourth axis.

17. An apparatus as defined in claim 1 wherein said fluid is a gas.

* * * * *